United States Patent [19]

Kiselman

[11] 4,218,904

[45] Aug. 26, 1980

[54] DOUBLE BOLT LOCK

[76] Inventor: Roman Kiselman, Los Angeles, Calif. 90046

[21] Appl. No.: 943,937

[22] Filed: Sep. 20, 1978

[51] Int. Cl.[2] ..... E05B 65/06

[52] U.S. Cl. ..... 70/134; 70/409

[58] Field of Search ..... 70/52, 134, 364 R, 377, 70/393, 402, 405, 407, 409, 352; 292/150

[56] References Cited

U.S. PATENT DOCUMENTS

| | | | |
|---|---|---|---|
| 1,510,562 | 10/1924 | Segal | 292/150 |
| 2,301,155 | 11/1942 | Sebestyen | 70/387 |

*Primary Examiner*—Robert L. Wolfe

*Attorney, Agent, or Firm*—Huebner & Worrel

[57] ABSTRACT

A double deadbolt lock having a housing in which two latch bolts are mounted for reciprocal movement between an extended locking position and a retracted unlocked position. The bolts are in transverse alignment so as to have an elongated face on one opposite an elongated face on another. Each of the two opposite faces has a pattern of alternate, allochirally arranged lands and grooves extending obliquely away from one end of the bolts toward the other end. The housing has a keyhole extending therethrough in alignment with the said opposite faces of the bolts. The key for locking and unlocking the bolts has a shaft having a cross-sectional size and shape corresponding to the size and shape of the hole. Opposite edges of the shaft have alternate lands and grooves complementary respectively to corresponding lands and grooves of the latch bolts. For operating the lock, the key has a reciprocal path of travel through the keyhole, during which the lands and grooves of the shaft engage respective grooves and lands of the latch bolts for linear movement therein, so that when the shaft is moved linearly in one direction the latch bolts are moved linearly to an extended locking position, and when moved linearly in the opposite direction, the latch bolts are retracted linearly to an unlocked position.

8 Claims, 5 Drawing Figures

DOUBLE BOLT LOCK

BACKGROUND OF THE INVENTION

There is an increasing demand for deadbolt locks for all types of doors, but the typical lock having a deadbolt and which can be opened with a key from the outside has become quite expensive. They are particularly costly when bought in large numbers for apartments, for example.

One of the problems with apartment house locks is that the tenants move out and frequently take keys with them. This destroys the security of the locks which the keys fit, and requires for a typical tumbler lock, that the apartment house owner, or the tenant, call a locksmith to change the tumblers and provide new keys. This also is very expensive.

SUMMARY OF THE INVENTION

The present invention reduces the problem of the initial expense of the installation and/or purchase of tumbler operated deadbolt locks and also eliminates the need for a locksmith to adapt a lock to be operated with a new key.

The present invention provides a relatively inexpensive lock structure which is comprised of a housing made from a single casting and in which two deadbolts are mounted for reciprocal movement with respect to the housing and door. The deadbolts are in the form of rectangular prisms and have alternate, oblique lands and grooves on one face which can be inexpensively accomplished with a machine tool. The key is made to have alternate lands and grooves on two opposite edges so as to be movable into complementary grooves and lands in the two opposite faces of the bolts so that linear movement of the key in one direction retracts the bolts inwardly to an unlocked position and linear movement in the opposite direction moves the bolts to an extended locking position.

Accordingly, it is an object of the invention to provide a new improved deadbolt lock which is simple, relatively inexpensive to manufacture, rugged and secure.

It is another object of the invention to provide a lock, as described in the preceding paragraph, which has relatively few parts which are easily removed from the housing and which can be easily replaced by inexpensive substitutes operable with a different key.

It is still another object of the invention to provide a lock, as described in the preceding paragraphs, which is unusually secure in that the bolts are spring biased into a locked position which makes it very difficult to pick. In addition, when the lock is operated from the inside only one bolt need be moved to the locking position and this prevents the insertion of a key from the exterior and also removes a very substantial part of the working space in the key for attempted picking.

It is a further object of the invention to provide a lock, as described in the preceding paragraphs, in which the bolts and keys are relatively easy to change without the aid of a locksmith. They can be made with the simplest kind of machine tool operations, and it is inexpensive for an apartment house owner to buy sets of various combinations of bolts and keys which he can install with great ease to replace sets in locks where tenants have moved. The same is true for office buildings and hotels.

A screwdriver is the only tool needed to change the latch bolts.

It is a still further object of the invention to provide a lock, as described in the preceding paragraphs, for which the key is very difficult to duplicate without knowing its specific structure.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENT

Figure 1:
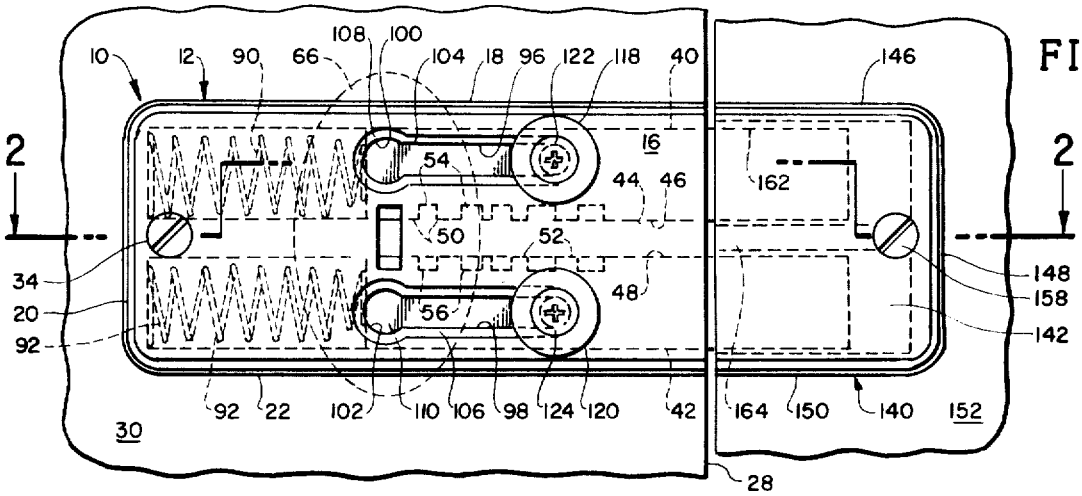
FIG. 1 is a side elevational view of the lock according to the invention installed on a door.
Figure 2:
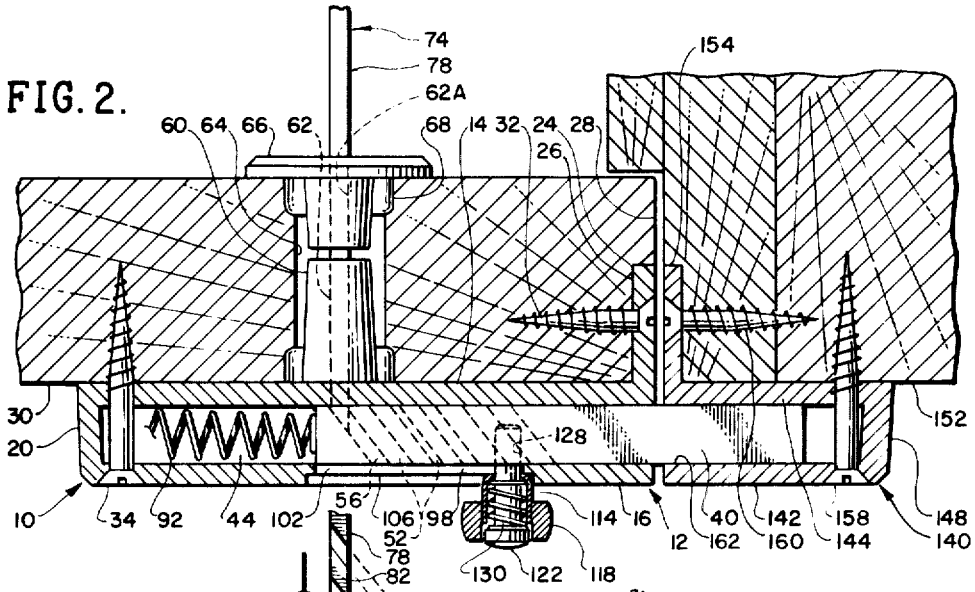
FIG. 2 is a partially cross-sectional view, taken substantially along the lines 2—2 in FIG. 1.
Figure 5:
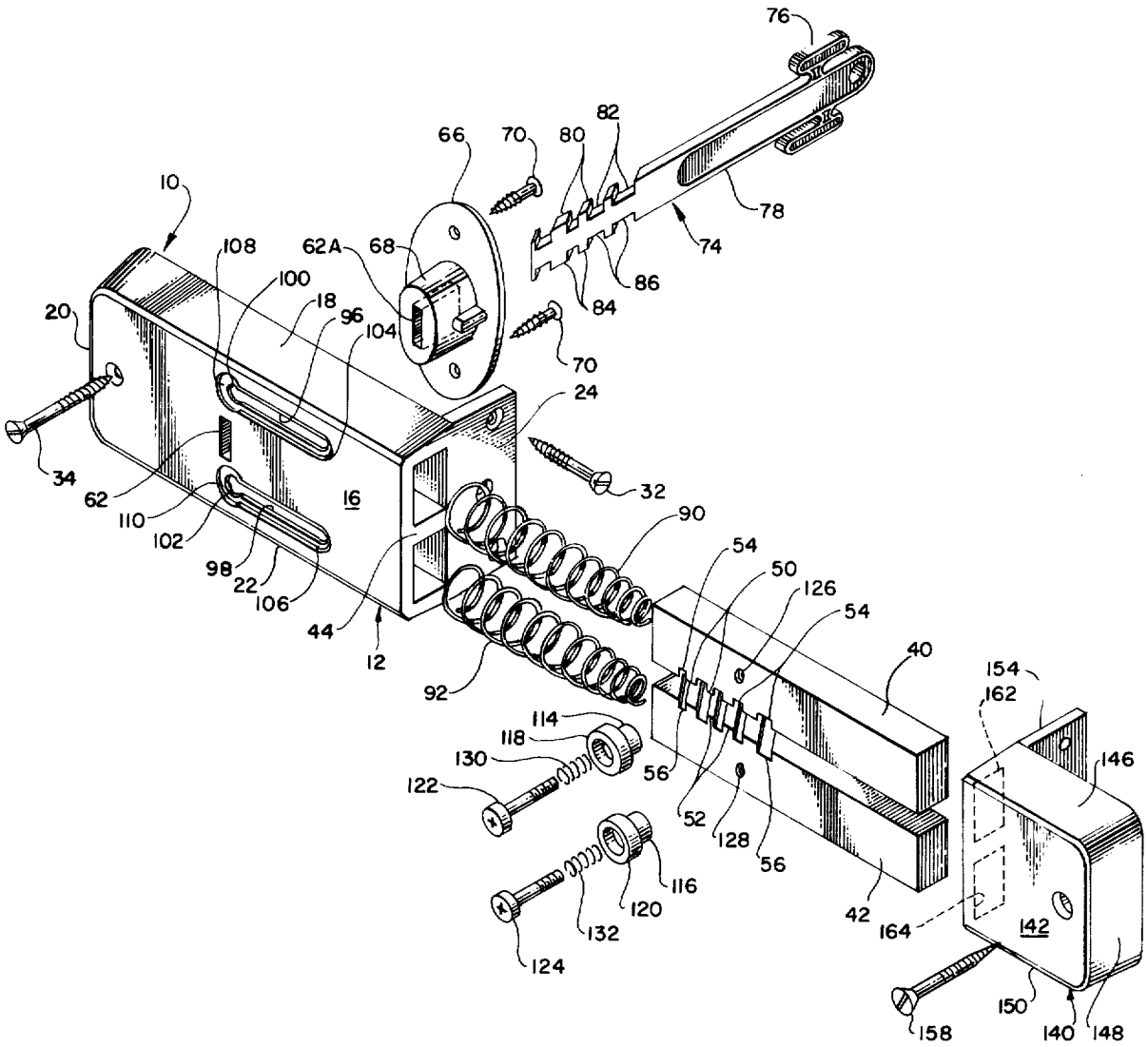
FIG. 5 is an exploded view of the lock and key.

Referring again to the drawings, in FIGS. 1, 2 and 5 there is shown a double bolt lock, generally designated as 10. The lock has a housing 12 made from a single casting. The housing has a bottom wall 14 adapted to be secured internally on a door 30, an opposite or outer wall 16 and side walls 18, 20 and 22. Extending from an outer end of the bottom wall 14 is a flange 24, adapted to be secured in a recess 26 on a door edge 28 of the door 30, as shown in FIG. 2. The flange 24 is secured to the door 30 by means of three screws 32 and the other end of the housing is secured to the door by one screw 34.

Figure 3:
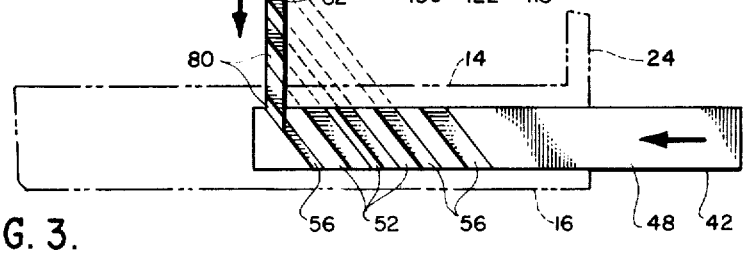
FIG. 3 is a fragmentary view illustrating the operation of the key with the bolt in the locked position.
Figure 4:
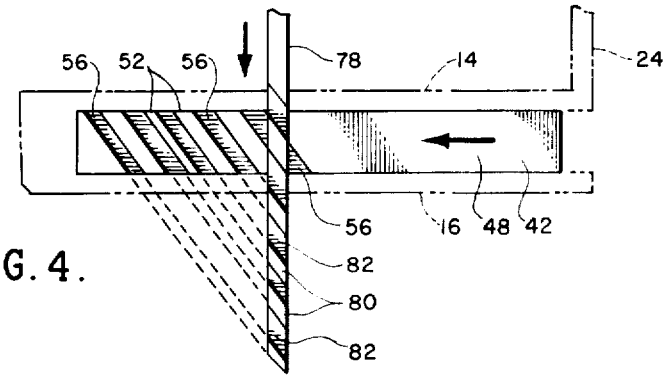
FIG. 4 is a fragmentary view illustrating the operation of the key with the bolt in the retracted position.

The walls of the housing have inner faces forming a chamber in which two latch bolts 40 and 42 are slidably engaged for reciprocating movement to an extended lock position, FIGS. 1–3, and retracted to an unlocked position, FIG. 4. The latch bolts are rectangular prisms, transversely aligned, and spaced from each other by a chamber partition wall 44, FIGS. 1 and 5. The latch bolts have two opposite faces 46 and 48 adjacent the faces of the partition 44.

Adjacent the inner ends of the faces 46 and 48 are a plurality or pattern of lands 50 and 52, respectively, spaced by grooves 54 and 56, respectively. The lands and grooves are at oblique angles with respect to the direction of reciprocal movement of the latch bolts and are substantially parallel to each other. In each pair of bolts the lands and grooves should be in allochiral relationship and complement the key. In different sets of bolts and keys the lands and grooves may be varied in angles and breadth, and the grooves may be varied in depth.

As a part of the casting, a truncated portion 60 extends from the bottom wall 14 and has a keyhole 62 therein, the keyhole extending through the housing. The truncated portion 60 extends to a bore 64 drilled into the door and fitted on the exterior of the door and bore is a key plate 66 having a truncated portion 68 in which there is a keyhole 62A in alignment with the keyhole 62. The plate 66 is secured to the outer surface of the door by two screws 70, FIG. 5. The keyholes are rectangular, of oblong shape. A key 74 has a handle 76 and a shaft 78, the shaft being of cross-sectional size and shape substantially corresponding to the size and shape of the keyhole. The shaft 78 has two opposite edges in which there are a pattern of allochirally arranged lands and grooves 80, 82 and 84, 86, respectively. As shown in FIGS. 3 and 4, the lands and grooves in the key fit the grooves and lands in the bolts and for each key and each set of bolts the lands and grooves must be complementary.

As shown in FIGS. 1, 2 and 5, between the inner end of the bolts 40 and 42 and the side wall 20 extend coil springs 90 and 92, respectively, so as to bias the bolts toward an extended locking position.

Formed in the wall 16 are two parallel slots 96 and 98 exposing the latch bolts 40 and 42, respectively. At the inner end of the slots with respect to the inner ends of the latch bolts are two enlarged generally cylindrical slot extensions 100 and 102. Surrounding the slots are recessed shoulders 104 and 106, and substantially surrounding the slot extensions are shoulder continuations 108 and 110. Detents 114 and 116 and their respective knobs 118 and 120 are secured to bolts 40 and 42 by screws 122 and 124 in bores 126 and 128, respectively. The detents are biased to abut the shoulders 104 and 106 by means of coil springs 130 and 132, respectively, surrounding the screws. In the position shown in FIGS. 1 and 2, the detents stop the movement of the latch bolts in the extended locking position and retain the bolts in the locks against the force of the springs 90 and 92. The only tool required to change the latch bolts is a screwdriver to loosen and tighten the screws 122 and 124. When the knobs 118, 120 are moved in the direction toward the inner ends of the bolts to move the bolts to the retracted position, if the detents are moved far enough so as to be positioned in alignment with the enlarged extensions 100 and 102, the springs 130 and 132 force the detents therein to secure the bolts in the retracted position.

As shown in FIGS. 1, 2 and 5, the latch bolts in the extended locking position are engaged in a retention bracket 140. The bracket 140 has an outer wall 142 spaced from an inner bottom wall 144 by side walls 146, 148 and 150. The inner wall is positioned on an inner door frame surface 152 and extending from the inner wall is a flange 154 set in a recess in the door frame opposite the flange 24 on the housing. The bracket 140 is secured to the door frame by one screw 158 and two screws 160. The bracket has two spaced openings 162 and 164 adapted to receive the latch bolts 40 and 42 in the extended locked positions.

In operation, referring to FIGS. 1 and 2, the latch bolts 40 and 42 are shown in extended locked positions within the retention bracket 140 to lock the door 30. To unlock the door from the inside, the knobs 118 and 120 are moved to the left along the respective slots and if it is desired to secure the latch bolts in the retracted position the detents are moved into the enlarged extensions in which they will be held by the springs 130 and 132. To release the detents from the extensions, the knobs 118 and 120 are lifted away from the housing to pull the detents out of the extensions against the force of the springs. After they are lifted to the level of the shoulders 104 and 106 the springs 90 and 92 will force the latch bolts into the extended locked position.

When it is desired to lock the door from the outside, the latch bolts are moved into the extended locked position, FIG. 3, with the door open. Then the key 78 is inserted into the keyhole from the outside where a first land 84, not shown in FIG. 3, is moved into a first groove 56. As the key is continuously moved inwardly into successive lands and grooves in both latch bolts and both edges of the key are engaged, the engagement causes a camming action to move the latch bolts to the unlocked position, FIG. 4, with the inner end of the key extending inwardly of the door. The key moves the latch bolts linearly inwardly into the housing so that the outer end of the bolts do not protrude beyond the flange 24 and so that the detents do not go inwardly beyond the end of the slots 96 and 98. That is, the bolt does not travel inwardly a distance longer than the lengths of the slots and the detents are not permitted to enter the enlarged extensions 100 and 102.

The door is then closed and the key is withdrawn from the position shown in FIG. 4 to the position shown in FIG. 3 and outwardly of the plate 66. Before the key is fully withdrawn, FIG. 3, the latch bolts are in the extended locking position where they are held by means of the springs 90 and 92. With both springs biasing the latch bolts in the locked position, it would be difficult, if not impossible, to pick the lock to move both latch bolts to the unlatched position.

When locking from the inside, only one latch bolt need be moved into the extended locked position and the other bolt is then in the fully retracted position held in place by the detent in the respective slot extension. This prevents the insertion of a key into the keyhole beyond the unlatched bolt and also makes it very difficult to attempt to open the latch bolt with a tool or tools other than a key.

From the foregoing it is easily seen how sets of new latch bolts and keys can be used with the housing without significant expense and effort of removal of the old bolts and insertion of the new bolts. The changing is so economical that a landlord could afford to change the locks every time a tenant has moved, even though a tenant leaves keys behind, considering that the tenant could have had additional keys made.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A dead lock comprising:

a lock housing forming a chamber open at one end, a pair of elongated transversely aligned, latch bolts mounted for reciprocal movement in said chamber and through said open one end, elongated faces of said bolts being in sliding relationship with respect to said chamber, a first face on one bolt and a first face on the other bolt, said first faces being opposite each other, said first faces having a pattern of alternate, allochirally arranged lands and grooves, said lands and grooves extending obliquely away from one end of the bolts toward the other end, said housing having a keyhole extending therethrough in alignment with said first faces of said bolts, a key having a handle and a shaft extending from the handle, said shaft having a cross-sectional size and shape substantially corresponding to the size and shape of the keyhole, opposite edges on said shaft having alternate lands and grooves complementary respectively to corresponding grooves and lands of the latch bolts, said key having a reciprocal path of travel through the keyhole during which the lands and grooves of the shaft engage respective grooves and lands of the latch bolts for linear movement therein, whereby when the shaft is moved linearly in one direction, the latch bolts are moved linearly to an extended locking position and when the shaft is moved linearly in the opposite direction the latch bolts are retracted linearly to an unlocked position, and means associated with the housing and latch bolts for moving each bolt independently into an extended locking position and for retracting each bolt independently into a retracted unlocked position, said last means including means for securing one bolt in the unlocked position while the other bolt is in the locked position, said unlocked bolt being in position to prevent entry of the key to unlock the locked bolt.

2. The invention according to claim 1 in which:

the lands and grooves are variable in oblique angles, in breadth and in spacing and said grooves are variable in depth to implement employment of different key and lock combinations.

3. The invention according to claim 1 in which:

said means for moving said bolts include springs in said chamber abutting a chamber wall at one end and the inner ends of said bolts at the other end to bias them into the locked position and to hold them in said last position.

4. The invention according to claim 1 in which:

said chamber has a bottom wall adapted to be secured to a door and has an opposite wall spaced from said bottom wall by side walls, said latch bolts being in sliding relationship with inner faces of said walls, said lands and grooves being adjacent one end of said bolts, said reciprocal path of travel of the key being substantially perpendicular to the reciprocal movement of the latch bolts, said key shaft being removable from said keyhole to a position where said lands and grooves of said key are free from engagement with said lands and grooves of said bolts.

5. The invention according to claim 4 in which:

said housing is a single casting.

6. The invention according to claim 3 including:

a wall of said chamber adapted to be spaced inwardly of a door to which the housing is securable, the latch bolts being adapted to be inwardly of said last wall toward the door, said last wall having two slots therethrough, each exposing a respective latch bolt, said bolts being as long as the travel of said bolts from the locked position to the unlocked position by the unlocking with key, spring biased detents each secured through a slot to a respective bolt and being adapted to travel with a bolt along and biased toward a respective slot, enlarged extensions of said slots through said last wall extending away from the locking direction, said detents being movable into said enlarged extensions and be secured therein by their springs to hold said bolts in unlocked positions.

7. A dead lock comprising:

a lock housing forming a chamber open at one end, a pair of elongated transversely aligned, latch bolts mounted for reciprocal movement in said chamber and through said open one end, elongated faces of said bolts being in sliding relationship with respect to said chamber, a first face on one bolt and a first face on the other bolt, said first faces being opposite each other, said first faces having a pattern of alternate, allochirally arranged lands and grooves, said lands and grooves extending obliquely away from one end of the bolts toward the other end, said housing having a keyhole extending therethrough in alignment with said first faces of said bolts, a key having a handle and a shaft extending from the handle, said shaft having a cross-sectional size and shape substantially corresponding to the size and shape of the keyhole, opposite edges on said shaft having alternate lands and grooves complementary respectively to corresponding grooves and lands of the latch bolts, said key being insertable into and removable from the keyhole and having a reciprocal path of travel through the keyhole during which the lands and grooves of the shaft engage respective grooves and lands of the latch bolts for linear movement therein, whereby when the shaft is moved linearly in one direction, the latch bolts are moved linearly to an extended locking position and when the shaft is moved linearly in the opposite direction the latch bolts are retracted linearly to an unlocked position, and means associated with the housing and latch bolts for moving each bolt independently into an extended locking position and for retracting each bolt independently into a retracted unlocked position.

8. The invention according to claim 7 in which:

said last means include means for securing one bolt in the unlocked position while the other bolt is in the locked position, said unlocked bolt being in position to prevent entry of the key to unlock the locked bolt.

* * * * *